US005236123A

United States Patent [19]

Stone et al.

[11] Patent Number: 5,236,123

[45] Date of Patent: Aug. 17, 1993

[54] CARTON AND LINER TEAR-TAPE ASSEMBLY

[76] Inventors: James L. Stone, 640 Lake Dr., SE., Grand Rapids, Mich. 49503; Thomas J. Weber, 473 Thunderhead Canyon Dr., Ballwin, Mo. 63011

[21] Appl. No.: 957,681

[22] Filed: Oct. 7, 1992

[51] Int. Cl.[5] ..... B65D 5/56; B65D 5/54

[52] U.S. Cl. ..... 229/225; 220/410; 220/418; 229/160.2

[58] Field of Search ..... 229/160.2, 208, 224, 229/225, 235; 220/408, 410, 416, 418

[56] References Cited

U.S. PATENT DOCUMENTS

| | | | |
|---|---|---|---|
| 900,953 | 10/1908 | Reber | 229/225 |
| 901,286 | 10/1908 | Ferres et al. | 229/225 |
| 2,011,438 | 8/1935 | Daller | 229/225 |
| 2,836,343 | 5/1958 | Will | 229/225 |
| 3,593,911 | 7/1971 | Pellaton | 229/225 |
| 3,910,482 | 10/1975 | Bamburg et al. | 220/418 |
| 4,865,203 | 9/1989 | Ueda | 229/225 |
| 4,986,420 | 1/1991 | Gunn et al. | 229/225 |
| 5,058,748 | 10/1991 | Giblin et al. | 220/416 |
| 5,154,343 | 10/1992 | Stone | 229/224 |

FOREIGN PATENT DOCUMENTS

| | | | |
|---|---|---|---|
| 2046484 | 9/1970 | Fed. Rep. of Germany | 229/225 |
| 2002995 | 7/1971 | Fed. Rep. of Germany | 220/418 |
| 3140389 | 6/1983 | Fed. Rep. of Germany | 229/225 |

*Primary Examiner*—Gary E. Elkins

*Attorney, Agent, or Firm*—Arnold, White & Durkee

[57] ABSTRACT

A liner-carton assembly includes a tear-tape mechanism for use with an offset printing operation. The assembly includes a carton having a top, a bottom, a pair of opposing sides and a flip-open top section including the top and a portion of the opposing sides. The liner is constructed and arranged to provide structural support to the carton and it includes a pair of opposing sides for fitting the liner snugly inside the carton. Moreover, the liner includes a tear-tape material on an outside surface thereof, and the carton includes means adjacent the tear-tape for tearing the top section along at least three sides to access the inside of the carton. Further, a two-part tab, which includes a first part connected to the tear-tape material and a second part connected to the carton, permits a user to hand-grasp the tab and pull the tear-tape material and separate the top section of the carton.

15 Claims, 4 Drawing Sheets

CARTON AND LINER TEAR-TAPE ASSEMBLY

FIELD OF THE INVENTION

The present invention generally relates to paperboard carton liners. More specifically, the present invention relates to an improved carton and liner assembly having a tear-tape opener.

BACKGROUND OF THE INVENTION

A variety of paperboard or cardboard sleeve-type liners are commercially available. Paperboard liners are typically cut from long rolls of paperboard into rectangular sections. Each such rectangular section, which is commonly referred to as a "blank," is formed into a four-sided tubular shape for insertion into a slightly larger container to impart vertically oriented structural support to the larger box. The added support provided by the liner allows the boxes to be safely stacked during storage an transit.

The liners are formed from the blanks by folding the rectangular sections along vertical score lines which are scribed between the sections. The two outer rectangular sections are secured to one another using a flap, which extends from one of the two outer rectangular sections and is glued to the other of the two outer rectangular sections.

Once assembled, the liner is ready to be inserted within a slightly larger box. The liner and carton are designed such that there is a snug fit between the liner and the carton. In some applications, glue is applied to the outer surface of the liner and/or the inner surface of the slightly larger carton so that the liner is securely anchored.

Other applications do not use liners. In some powder detergent carton applications, for example, a perforated area is included on one side of the top portion of the carton, such that the user can puncture the perforated area to access the detergent. In other arrangements the carton is provided with tear-back flaps covering the top of the carton.

These arrangements, unfortunately, are inconvenient. The arrangement in which the perforated area is punctured requires a knife or other sharp object to break through to the carton contents. Moreover, in both of the above-discussed arrangements, once access to the carton contents has been provided, preventing spillage is not easily accomplished. The punctured perforated area does not reclose the carton, and the flip-open lid provides an opening where the lid meets the remainder of the carton.

Another known implementation includes a liner-carton assembly having a tear-tape material on the backside, or inside, of the outer carton. Using a tab extending from the carton and by pulling the end of the tab which includes the tear-tape material, a strip of paperboard material parallel to the carton's top surface is removed from the remainder of the carton to provide a flip-open recloseable top. This implementation is manufactured using the Gravure (or equivalent) printing operation, and it involves applying the tear-tape material to the back side of the carton after the printing stations and before die-cutting the individual cartons. Thus, this implementation is feasible for large volumes, because long rolls of cartons can be manufactured with the steps of printing and applying the tear-tape material already completed before the die-cutting process.

Using an offset printing operation rather than the Gravure, however, this liner-carton implementation is not feasible for manufacturing large volumes of cartons. This is because the offset printing operation involves processing rolls of carton paperboard through a sheeter before the printing press stations, and the tear-tape cannot be economically or efficiently adhered to the carton paperboard after the sheeter. Moreover, the tear-tape material cannot be adhered to the back side of the carton paperboard before the printing press stations, because the thickness of the tear-tape material would cause uneven printing on the front side (or outside) of the carton.

Accordingly, there is a need for a paperboard liner arrangement which can be manufactured independent of the type manufacturing equipment and which overcomes the afore-mentioned deficiencies of the prior art.

SUMMARY OF THE INVENTION

In view of the foregoing, the present invention provides a carton-liner assembly which includes a tear-tape mechanism associated with both the liner and the carton such that when torn, the assembly provides a reclosable hinged lid for spillage-resistant access to the carton contents.

The present invention also provides a carton-liner assembly which can be manufactured using any of a variety of manufacturing operations, including offset, web-offset and Gravure.

In a specific embodiment of the present invention, a liner-carton assembly includes: a carton having a top, a bottom, a pair of opposing sides and a top section including the top and a portion of the opposing sides; a liner constructed and arranged to provide structural support to the carton and including a pair of opposing sides for fitting the liner snugly inside the carton; wherein the liner includes a tear-tape material on its outer surface thereof, and the carton includes a guiding perforation-like or cut-scored section adjacent the tear-tape material for removing a desired portion of outer carton top section to access the inside of the carton.

Another aspect of the present invention involves the process of making a liner-carton assembly by forming a carton having a top, a bottom, a pair of opposing sides and a top section such that the top section includes the top and a portion of the opposing sides; forming a liner to provide structural support to the carton an providing the liner with a pair of opposing sides for fitting the liner snugly inside the carton and a tear-tape material on a surface thereof; providing means adjacent the tear-tape material for at least partially tearing the top section to access the inside of the carton; and forming the liner-carton assembly by securing the liner to the inside of the carton.

BRIEF DESCRIPTION OF THE DRAWINGS

Other objects and advantages of the invention will become apparent upon reading the following detailed description and upon reference to the drawings in which.

Figure 1:
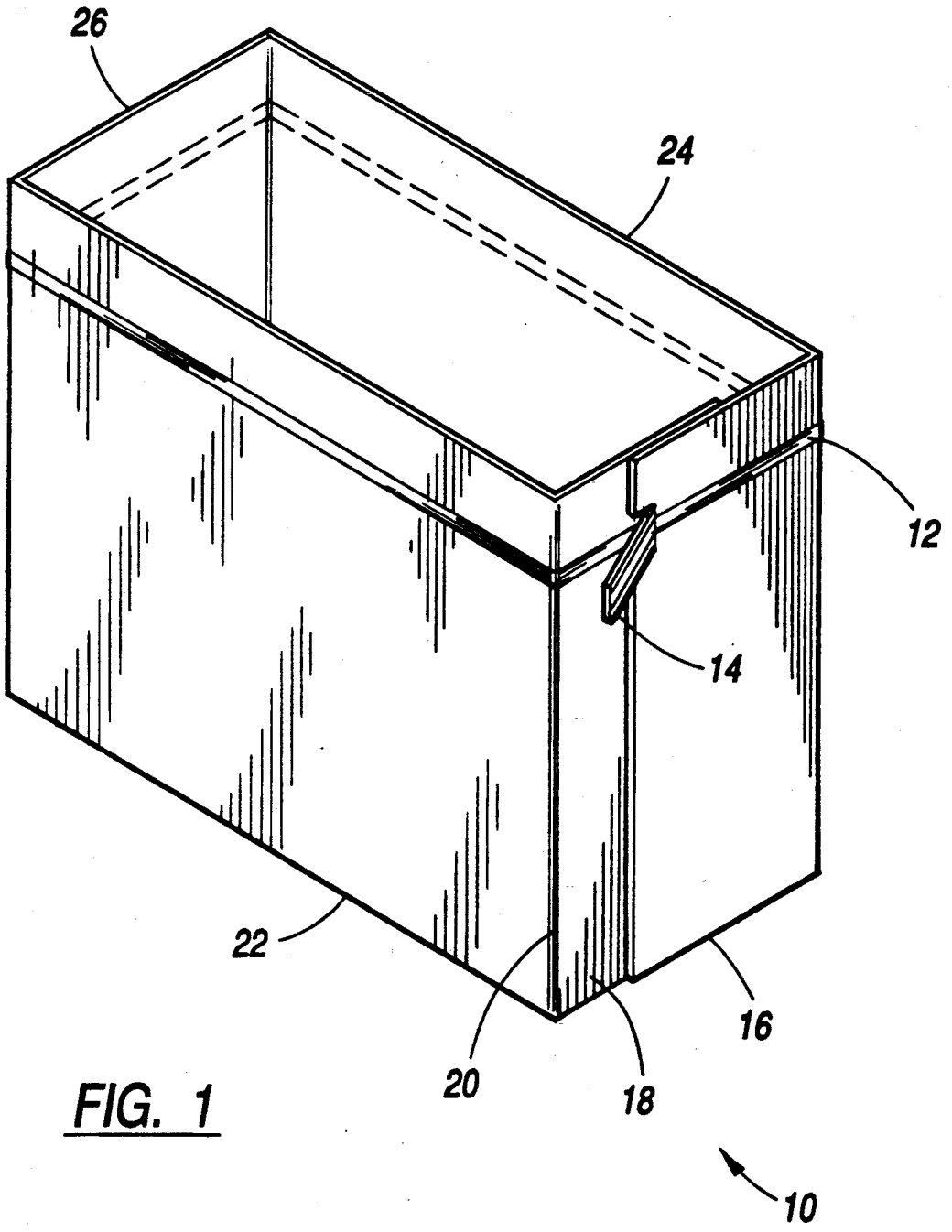
FIG. 1 is perspective view of a formed paperboard liner having a tear-tape mechanism, in accordance with the present invention.

While the invention is susceptible to various modifications and alternative forms, specific embodiments thereof have been shown by way of example in the drawings and will be described in detail. It should be understood, however, that the described embodiments, and the phraseology and terminology used in connection therewith, are not intended to limit the invention to the particular forms described. On the contrary, the intention is to cover all modifications, equivalents, and alternatives falling within the spirit and scope of the invention as defined by the appended claims.

DETAILED DESCRIPTION OF THE PREFERRED EMBODIMENT

The present invention is particularly applicable and useful for paperboard container offset printing manufacturing applications in which the step of sheeting is performed before the printing operations and in which a liner is required to supplement the structural support of the container. These applications, for example, include manufacturing lined paperboard boxes containing such products as dry or powdered detergent, pet foods, lawn and garden product, etc. The present invention is not limited to such applications, however, and may be used for a variety of container types and shapes and in conjunction with a variety of manufacturing operations, including offset, web-offset and Gravure.

Turning now to the drawings and particularly to FIG. 1, there is shown a perspective view of a formed paperboard liner 10 having a tear-tape section 12 around the liner's outside surface. The tear-tape section 12 is located about an inch below the top of the liner, and the section includes a tear-tape tab 14 which enables the user to begin the tear. As illustrated, the tear-tape tab 14 is attached to and forms part of the rectangular end panel 16 overlapping the end panel 18, such that the end of the tab 14 approaches the corner post 20 formed by adjacent panels 18 and 22. Panels 18 and 22, and other indicated paperboard sections, are preferably secured to one another using a conventional hot-melt or cold adhesive.

The tear tape section 12 is implemented using a conventional open-assist tape-type material, for example, a hot-melt filament type tape, which is available from HB Fuller Co. or other types such a non-reinforced plastic film pressure sensitive tape. Application of this tape to the paperboard is accomplished using conventional heating means or conventional application systems well known to those practiced in the art. When removed from a paperboard liner which is constructed from chip board (such as the liner 10 shown in FIG. 1), only the tape (and possibly a thin outside layer of the liner) tears away. The remainder of the liner remains structurally intact for supporting the contents of the carton all the way to the top of the liner.

Figure 2:
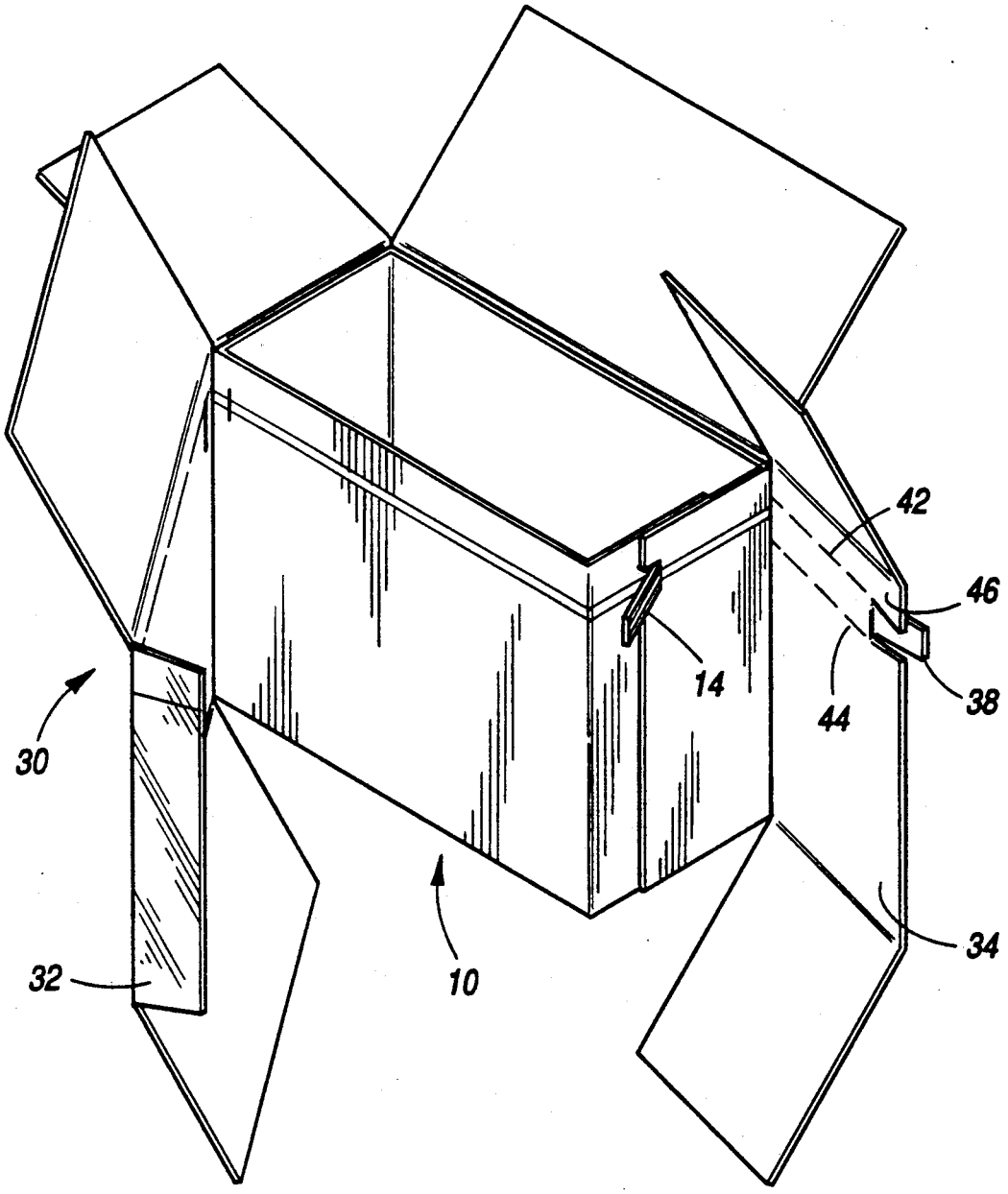
FIG. 2 is a perspective view of a liner-carton assembly, in accordance with the present invention, illustrating the formed paperboard liner of FIG. 1 partially within a similarly constructed carton.
Figure 3:
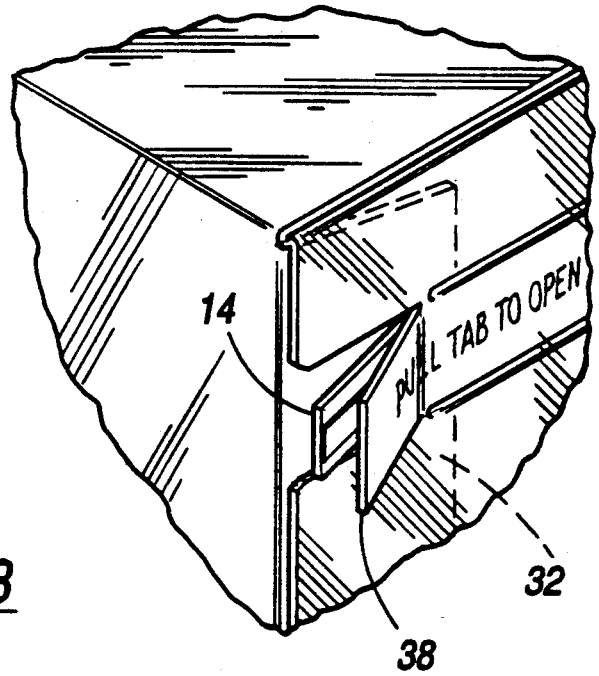
FIG. 3 is an enlarged perspective view of a portion of the liner-carton assembly of FIG. 2 and illustrating the tear-tape tab of the assembly.

FIG. 2 illustrates the liner 10 of FIG. 1 on the inside of a similarly constructed and partially formed carton 30. The outside surface of a panel (e.g., 24 of FIG. 1) of the liner 10 is partially adhered (adhesive not shown) to the inside surface of a corresponding panel of the carton 30. The carton 30 includes a flap 32 over which end panel 34 of the carton 30 is secured using the afore-mentioned adhesive. However, as shown in FIG. 3, the flap 32 tucks under the tear-tape tab 14, so that a pull-tab 38 on the carton can be pulled together with the tab 14. The pull-tab 38 of the carton 30 and the tear-tape tab 14 of the liner 10 can be adhered together or can be left detached.

The pull-tab 38 and the tear-tab 14 of the liner 10 break through the carton 30 along parallel lines 42, 44, which may be cut-scored or perforated regions permitting relatively easy tearing and removal or separation of the top portion 46 of the carton 30. Preferably, the parallel lines 42, 44 extend around only three contiguously adjacent sides of the carton 30, so that a reclosable lid 48 (FIG. 5) is formed once the tearing around the three contiguously adjacent sides has been completed.

Figure 4:
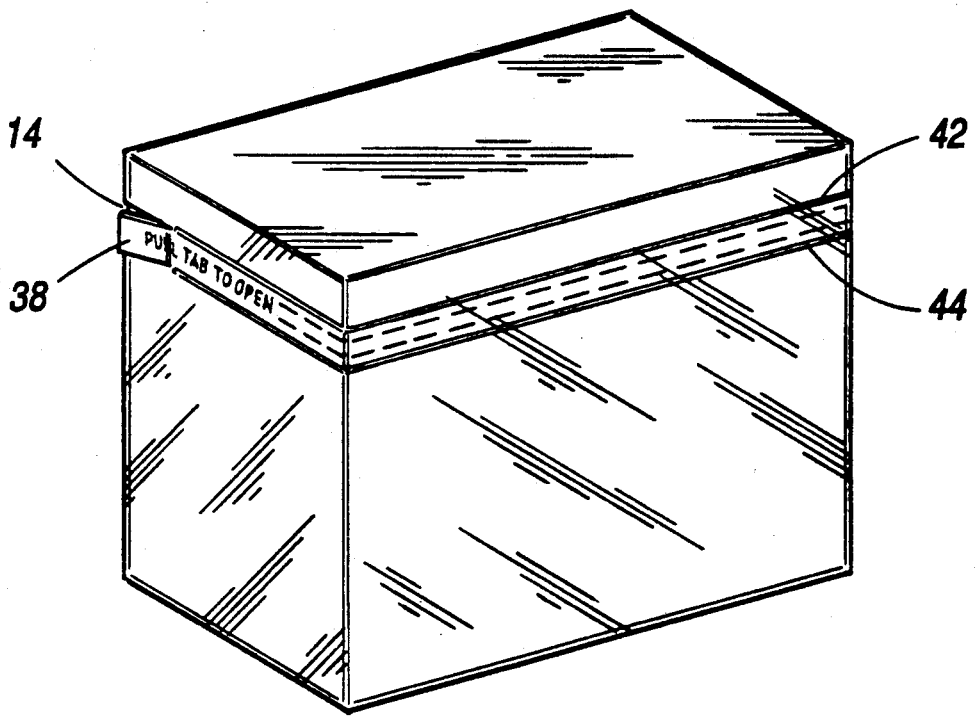
FIG. 4 is a perspective view of the liner-carton assembly of FIG. 2 with the liner of FIGS. 1 and 2 enclosed within the carton of FIG. 2.
Figure 5:
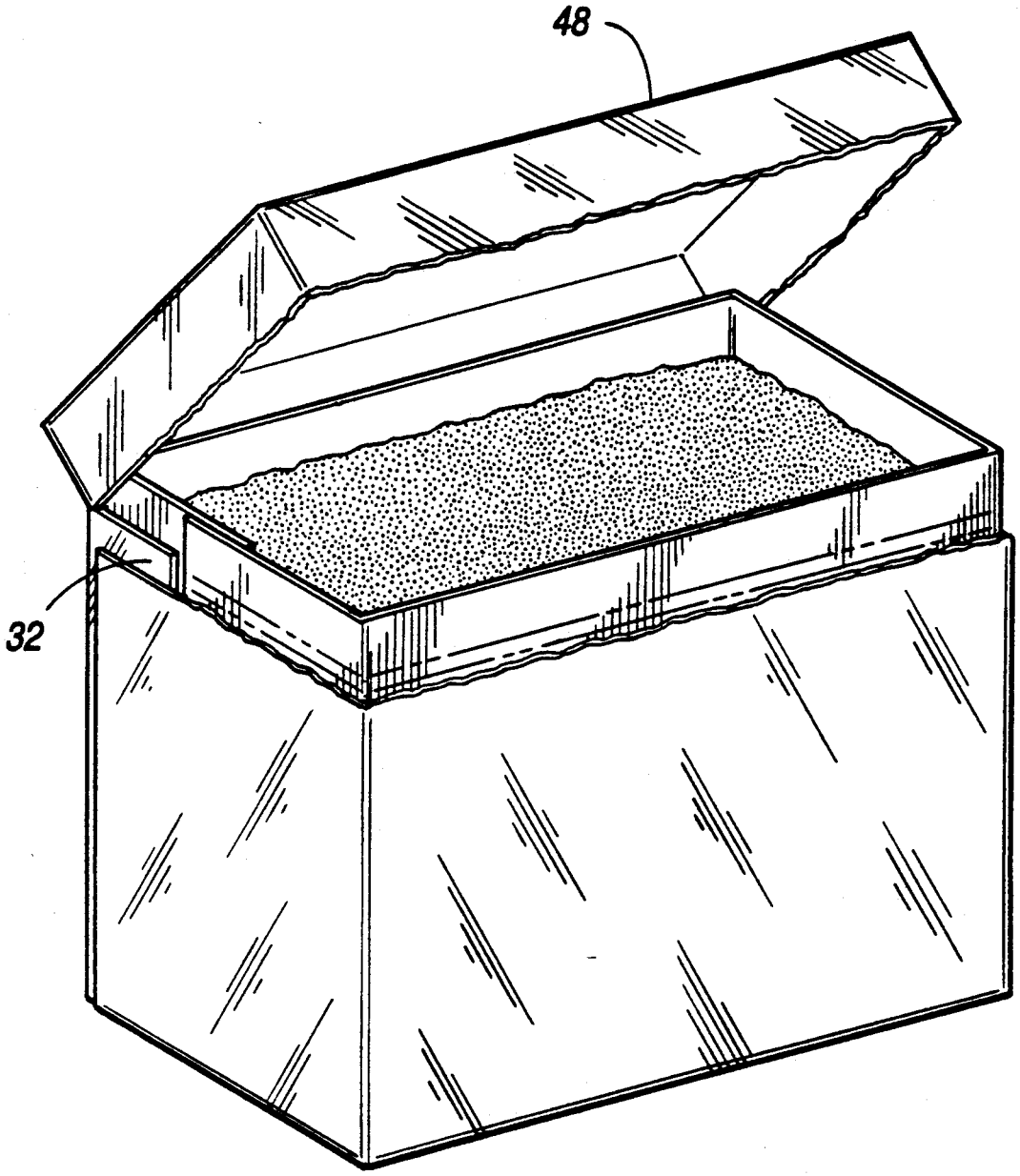
FIG. 5 is a perspective view of the liner-carton assembly of FIG. 4 after the tear tape is torn from the assembly.

FIGS. 4 and 5 illustrate the liner-carton assembly of the previous figures with contents enclosed therein "before" and "after" the pull-tab 38 and the tear-tab 14 have been pulled together along parallel lines 42, 44 around the three contiguously adjacent sides. The end result, as shown in FIG. 5, is a carton-liner assembly having a reclosable flip-like lid and a liner which extends from the bottom to the top of the carton for full carton use and spillage-resistant access to the carton contents.

While the present invention has been described with reference to particular embodiments, those skilled in the art will recognize that many changes may be made thereto. For example, one skilled in the art and aware of the liner design of co-pending patent application Ser. No. 07/958,013, entitled *Paperboard Container Liner* (PCOA-027) and concurrently filed herewith, would recognize that the embodiments shown herein may be modified to incorporate the removed sections of the liner to realize a paperboard savings. Also, the liner can be used only on the upper portion of carton to provide a frictional fit top for the hinged carton top section to reclose onto. Such changes do not depart from the spirit and scope of the present invention, which is set forth in the following claims.

I claim:

1. A liner-carton assembly, comprising:

a carton having a top, a bottom, a pair of opposing sides and a top section including the top and a portion of the opposing sides;

a liner constructed and arranged in the carton and including a pair of opposing sides for fitting the liner snugly inside the carton;

wherein the liner includes an open-assist tape-type material on a surface thereof, and the carton includes means adjacent the tape-type material for at least partially tearing the top section to access the inside of the carton.

2. A liner-carton, according to claim 1, wherein the liner extends from the top of the carton to the bottom of the carton so as to provide structural support to the carton.

3. A liner-carton, according to claim 1, wherein the surface of the liner upon which the tape-type material resides is adjacent an inside surface of the carton and wherein the liner is arranged to frictionally fit to the top section of the carton.

4. A liner-carton, according to claim 1, wherein the carton further includes means, located generally in parallel to the tape-type material, for facilitating separation of the top section of the carton.

5. A liner-carton, according to claim i, wherein the surface of the liner upon which the tape-type material resides is adjacent an inside surface of the carton, and the carton further includes means, located generally in parallel to the tape-type material, for facilitating separation of the top section of the carton.

6. A liner-carton, according to claim 1, further including a tab, connected to the tape-type material, which is constructed and arranged to permit a user to hand-grasp the tab for pulling the tape-type material and separating the top section of the carton.

7. A liner-carton, according to claim 6, wherein the tab includes a first portion which is attached to the liner and a second portion which is attached to the carton.

8. A liner-carton, according to claim 7, wherein the first and second portions are adhered to each other.

9. A liner-carton, according to claim 1, wherein the tape-type material is constructed and arranged on at least three contiguously adjacent sides of the carton.

10. A liner-carton assembly, comprising:

a carton having a top, a bottom, a pair of opposing sides and a top section including the top and a portion of the opposing sides;

a liner constructed and arranged to provide structural support to the carton and including a pair of opposing sides for fitting the liner snugly inside the carton;

wherein the liner includes a tear-tape material on an outside surface thereof, and the carton includes means adjacent the tear-tape material for tearing the top section along at least three sides to access the inside of the carton; and a two-part tab including a first part connected to the tear-tape material and a second part connected to the carton, said two-part tab being constructed and arranged to permit a user to hand-grasp the tab and pull the tear-tape material and thereby separate the top section of the carton.

11. A liner-carton, according to claim 10, wherein said means for tearing includes score lines.

12. A liner-carton, according to claim 11, wherein the score lines are included in at least three of the four sides of the carton.

13. A liner-carton, according to claim 10, wherein said means for tearing includes a pair of score lines arranged in parallel.

14. A liner-carton, according to claim 11, wherein the pair of score lines are included in at least three of the four sides of the carton.

15. A liner-carton, according to claim 10, wherein the opposing sides of the carton include one side having a flap portion which is secured to another one of the sides, and wherein the first part of the two-part tab overlaps the flap.

* * * * *